US012158294B2

(12) United States Patent
Michikami

(10) Patent No.: US 12,158,294 B2
(45) Date of Patent: Dec. 3, 2024

(54) AIR-CONDITIONING APPARATUS

(71) Applicant: Mitsubishi Electric Corporation, Tokyo (JP)

(72) Inventor: Kazuya Michikami, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 212 days.

(21) Appl. No.: 17/913,537

(22) PCT Filed: May 25, 2020

(86) PCT No.: PCT/JP2020/020544
§ 371 (c)(1),
(2) Date: Sep. 22, 2022

(87) PCT Pub. No.: WO2021/240599
PCT Pub. Date: Dec. 2, 2021

(65) Prior Publication Data
US 2023/0106624 A1 Apr. 6, 2023

(51) Int. Cl.
*F25B 41/31* (2021.01)

(52) U.S. Cl.
CPC ..... *F25B 41/31* (2021.01); *F25B 2400/23* (2013.01)

(58) Field of Classification Search
CPC ..... F25B 41/31; F25B 2400/23
See application file for complete search history.

(56) References Cited

U.S. PATENT DOCUMENTS

2004/0011980 A1 1/2004 Hirota
2011/0120161 A1* 5/2011 Hayashi ..... F25B 41/38 62/160
2018/0320942 A1* 11/2018 Hayamizu ..... F25B 1/00

FOREIGN PATENT DOCUMENTS

CN 108375170 A * 8/2018
JP 2004-101163 A 4/2004
JP 2008-070032 A 3/2008
JP 2010-025418 A 2/2010
JP 2013-164124 A 8/2013

OTHER PUBLICATIONS

Kang, Electronic Expansion Valve Control Method and Device and Air Conditioner, Aug. 7, 2018, CN108375170A, Whole Document (Year: 2018).*
International Search Report of the International Searching Authority mailed Jul. 28, 2020 for the corresponding International application No. PCT/JP2020/020544 (and English translation).

* cited by examiner

*Primary Examiner* — Larry L Furdge
(74) *Attorney, Agent, or Firm* — Posz Law Group, PLC

(57) ABSTRACT

An air-conditioning apparatus includes a refrigerant circuit including a compressor, a strainer, and an expansion valve, and a controller configured to control the expansion valve in the refrigerant circuit. In the air-conditioning apparatus, in a case where the expansion valve is closed, the controller performs control to close the expansion valve after opening the expansion valve to cause an opening port diameter of the expansion valve to be greater than a mesh diameter of the strainer.

3 Claims, 3 Drawing Sheets

AIR-CONDITIONING APPARATUS

CROSS REFERENCE TO RELATED APPLICATION

This application is a U.S. national stage application of International Patent Application No. PCT/JP2020/020544 filed on May 25, 2020, the disclosure of which is incorporated herein by reference.

TECHNICAL FIELD

The present disclosure relates to an air-conditioning apparatus including a strainer.

BACKGROUND

In an air-conditioning apparatus, a circulation amount of refrigerant is adjusted by an expansion valve. A gap between a valve and a valve sheet during refrigerant circulation is about 0.05 mm to about 0.5 mm because of characteristics of the expansion valve.

In an existing air-conditioning apparatus, a strainer that has a mesh structure to collect impurities flowing through a refrigerant pipe is commonly attached in front of and behind the expansion valve to prevent the expansion valve from being clogged with the impurities. In particular, in a replacement system using an existing refrigerant pipe, many impurities are present inside the refrigerant pipe. The strainer causes pressure loss in a refrigerant circuit. Therefore, the strainer having a hole diameter of about 0.3 mm to about 0.15 mm and 50 meshes to 100 meshes is selected.

PATENT LITERATURE

Patent Literature 1: Japanese Unexamined Patent Application Publication No. 2004-101163

When the air-conditioning apparatus operates in a state where the gap of the expansion valve is narrower than the strainer diameter, the gap between the valve and the valve seat of the expansion valve is clogged with the impurities circulating through the refrigerant circuit. When the expansion valve is closed while the gap is clogged with the impurities, the impurities are bitten into the gap of the expansion valve, causing damage on a valve shaft and the valve seat, and refrigerant leakage.

To improve this situation, it is necessary to make the hole diameter of the mesh structure of the strainer finer. However, when the hole diameter of the mesh structure is made finer with the same surface area to increase the number of meshes, the pressure loss in the refrigerant circuit is high, and occlusion by clogging easily occurs.

When the surface area of the mesh structure is increased, it is possible to suppress increase of pressure loss while increasing the number of meshes. However, when a volume of the strainer is increased, its cost is increased.

SUMMARY

The present disclosure is made in consideration of the above-described circumstances, and an object of the present disclosure is to provide an air-conditioning apparatus that can prevent the expansion valve from being clogged with impurities without increasing the number of meshes.

An air-conditioning apparatus according to an embodiment of the present disclosure includes a refrigerant circuit including a compressor, a strainer, and an expansion valve, and a controller configured to control the expansion valve in the refrigerant circuit. In the air-conditioning apparatus, in a case where the expansion valve is closed, the controller performs control to close the expansion valve after opening the expansion valve to cause an opening port diameter of the expansion valve to be greater than a mesh diameter of the strainer.

According to the embodiment of the present disclosure, in the case where the expansion valve is closed, the controller performs the control to close the expansion valve after opening a gap of an opening port of the expansion valve to be greater than the mesh diameter of the strainer. When the expansion valve is opened, minute impurities that have passed through the strainer and collected in the gap of the opening port of the expansion valve are swept away to the downstream. Accordingly, the air-conditioning apparatus can prevent the expansion valve from being clogged with the impurities without increasing the number of meshes.

DETAILED DESCRIPTION

Figure 1:
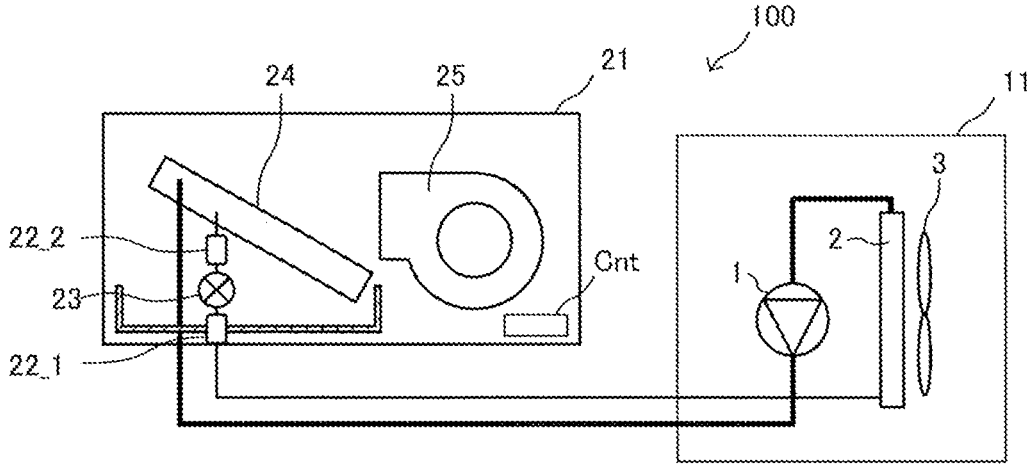
FIG. 1 is a diagram illustrating a configuration of an air-conditioning apparatus according to an embodiment.

An air-conditioning apparatus 100 according to an embodiment is described below with reference to drawings. Note that the same components are described while being denoted by the same reference numerals in the drawings, and repetitive descriptions are given only where necessary. The present disclosure can include all possible combinations of configurations described in the following embodiment.

Embodiment

FIG. 1 is a diagram illustrating a configuration of the air-conditioning apparatus 100 according to the embodiment.

The air-conditioning apparatus 100 includes an outdoor unit 11, and an indoor unit 21 to which the outdoor unit 11 is connected by a pipe.

The outdoor unit 11 includes a compressor 1, an outdoor heat exchanger 2, and an outdoor unit fan 3.

The indoor unit 12 includes a strainer 22_1, a strainer 22_2, an expansion valve 23, an indoor heat exchanger 24, an indoor unit fan 25, and a controller Cnt.

The compressor 1 compresses refrigerant flowing through the pipe.

The indoor heat exchanger 24 causes heat exchange to be performed between the refrigerant compressed by the compressor 1 and indoor air.

The strainer 22_2 has a mesh structure, and collects impurities included in the refrigerant having passed through the indoor heat exchanger 24.

The expansion valve 23 adjusts a circulation amount of the refrigerant having passed through the strainer 22_2.

The strainer 22_1 has a mesh structure, and collects impurities included in the refrigerant from the expansion valve 23.

The outdoor heat exchanger 2 exchanges heat between the refrigerant having passed through the strainer 22_1 and outdoor air. The refrigerant having passed through the outdoor heat exchanger 2 returns to the compressor 1.

The outdoor unit fan 3 sends air for heat exchange, to the outdoor heat exchanger 2.

The air-conditioning apparatus 100 includes a refrigerant circuit formed by the compressor 1, the outdoor heat exchanger 2, the strainer 22_1, the expansion valve 23, the strainer 22_2, and the indoor heat exchanger 24. The refrigerant circulates through the refrigerant circuit.

A flow switching valve selectively switching a flow direction of the refrigerant between the outdoor heat exchanger 2 and the indoor heat exchanger 24 may be provided on a discharge side of the compressor 1. In this case, cooling operation is performed in a case where the discharge side of the compressor 1 is connected to the outdoor heat exchanger 2, and heating operation is performed in a case where the discharge side of the compressor 1 is connected to the indoor heat exchanger 24. During the cooling operation, the indoor heat exchanger 24 serves as an evaporator. The indoor heat exchanger 24 evaporates the refrigerant, and takes heat from air of an air inlet by evaporative latent heat to supply cold air into a room. At this time, the outdoor heat exchanger 2 transfers latent heat to external air to liquefy the refrigerant. The liquefied refrigerant returns to the indoor heat exchanger 24 again through the expansion valve 23.

During the heating operation, in contrast to the cooling operation, the refrigerant that evaporates by taking latent heat from the external air in the outdoor heat exchanger 2 is condensed and rejects heat in the indoor heat exchanger 24. The flow direction of the refrigerant in the refrigerant circuit is opposite between the cooling operation and the heating operation.

Since the flow direction of the refrigerant is opposite between the cooling operation and the heating operation, the strainer 22_1 and the strainer 22_2 are preferably attached in front of and behind the expansion valve 23. Note that, in the air-conditioning apparatus 100 performing only one of the cooling operation and the heating operation, the strainer 22_1 or the strainer 22_2 may be provided on only one of the upstream side and the downstream side of the expansion valve 23.

The controller Cnt controls the whole of the air-conditioning apparatus 100. For example, the controller Cnt controls a valve opening degree of the expansion valve 23, an operation frequency of the compressor 1, and operation of the indoor unit fan 25 and the outdoor unit fan 3.

In a case where the controller Cnt is dedicated hardware, the controller Cnt corresponds to, for example, a single circuit, a composite circuit, an application specific integrated circuit (ASIC), a field programmable gate array (FPGA), or a combination thereof. Functional units realized by the controller Cnt may be each realized by individual hardware, or may be realized by one piece of hardware.

In a case where the controller Cnt is a CPU, each of functions performed by the controller Cnt is realized by software, firmware, or a combination of software and hardware. The software and the firmware are described as programs and stored in a memory. The CPU realizes each of the functions of the controller Cnt by reading out and executing the programs stored in the memory. The memory is, for example, a nonvolatile or volatile semiconductor memory such as a RAM, a ROM, a flash memory, an EPROM, and an EEPROM.

A part of the functions of the controller Cnt may be realized by dedicated hardware, and the other part of the functions may be realized by software or firmware.

Figure 2:
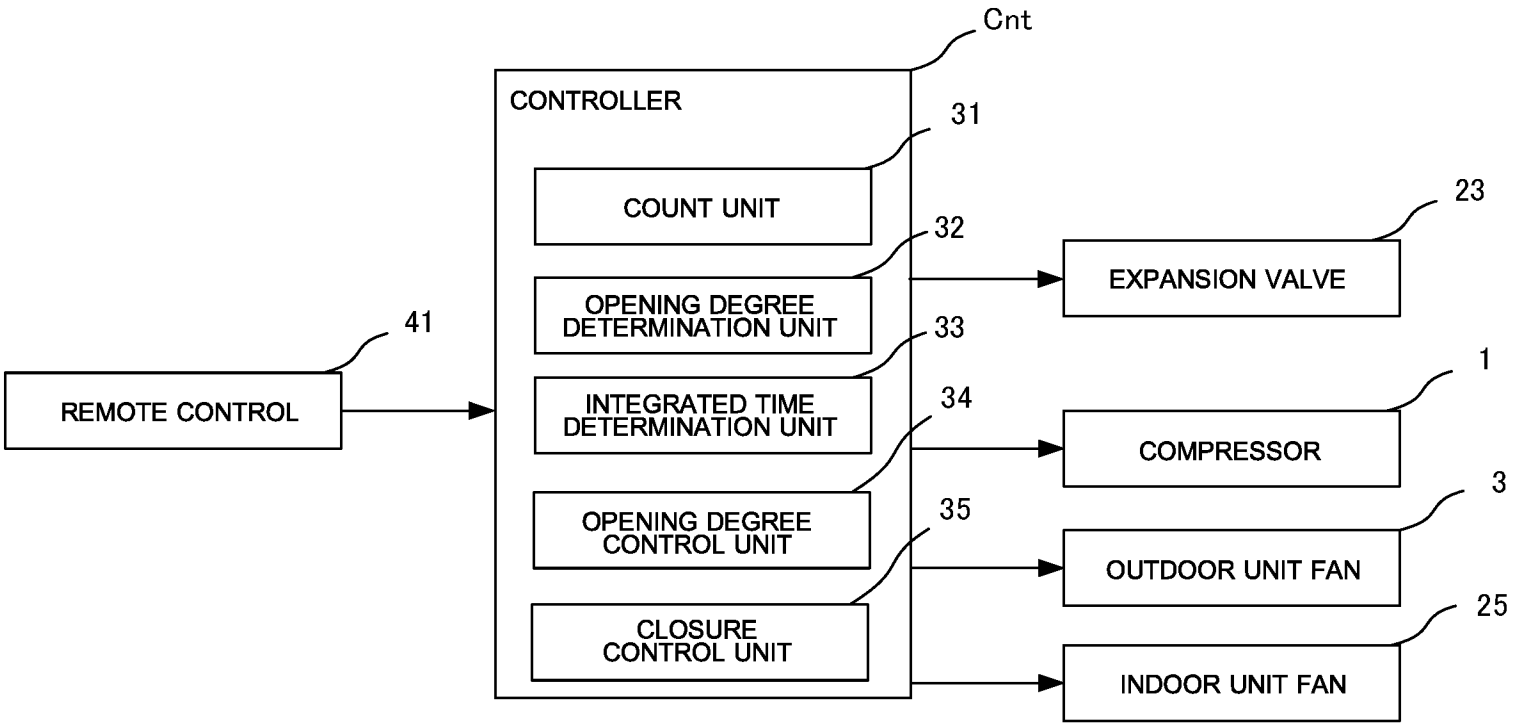
FIG. 2 is a block diagram illustrating functions of a controller of the air-conditioning apparatus according to the embodiment.

FIG. 2 is a block diagram illustrating the functions of the controller Cnt of the air-conditioning apparatus 100 according to the embodiment.

As illustrated in FIG. 2, the controller Cnt includes a count unit 31, an opening degree determination unit 32, an integrated time determination unit 33, an opening degree control unit 34, and a closure control unit 35.

In a case where operation start of the indoor unit 21 is instructed from a remote control 41 of the air-conditioning apparatus 100, the count unit 31 counts an integrated time (minutes) in a case where an opening degree A of the expansion valve 23 is less than or equal to a set opening degree Ap ($A \leq Ap$).

In a case where a mesh diameter of each of the strainer 22_1 and the strainer 22_2 is P [mm], the set opening degree Ap of the expansion valve 23 is $f(p) \times 1.1$ to 1.4. The value f(p) is an expansion valve opening degree [pls] at which a gap of an opening port of the expansion valve 23 becomes P, and is calculated based on characteristics of the expansion valve 23. The set opening degree Ap is an opening degree to prevent biting of impurities.

The opening degree determination unit 32 determines whether the opening degree A of the expansion valve 23 is greater than the set opening degree Ap.

The integrated time determination unit 33 determines whether the integrated time in the case where the opening degree A of the expansion valve 23 is less than or equal to the set opening degree Ap is greater than or equal to a threshold. The threshold is, for example, three minutes.

In a case where the integrated time determination unit 33 determines that the integrated time in the case where the opening degree A of the expansion valve 23 is less than or equal to the set opening degree Ap is greater than or equal to three minutes, the opening degree control unit 34 controls the opening degree A of the expansion valve 23 to the set opening degree Ap.

The closure control unit 35 closes the expansion valve 23. In the closure control, operation of the compressor 1, the outdoor unit fan 3, and the indoor unit fan 25 is stopped.

Figure 3:
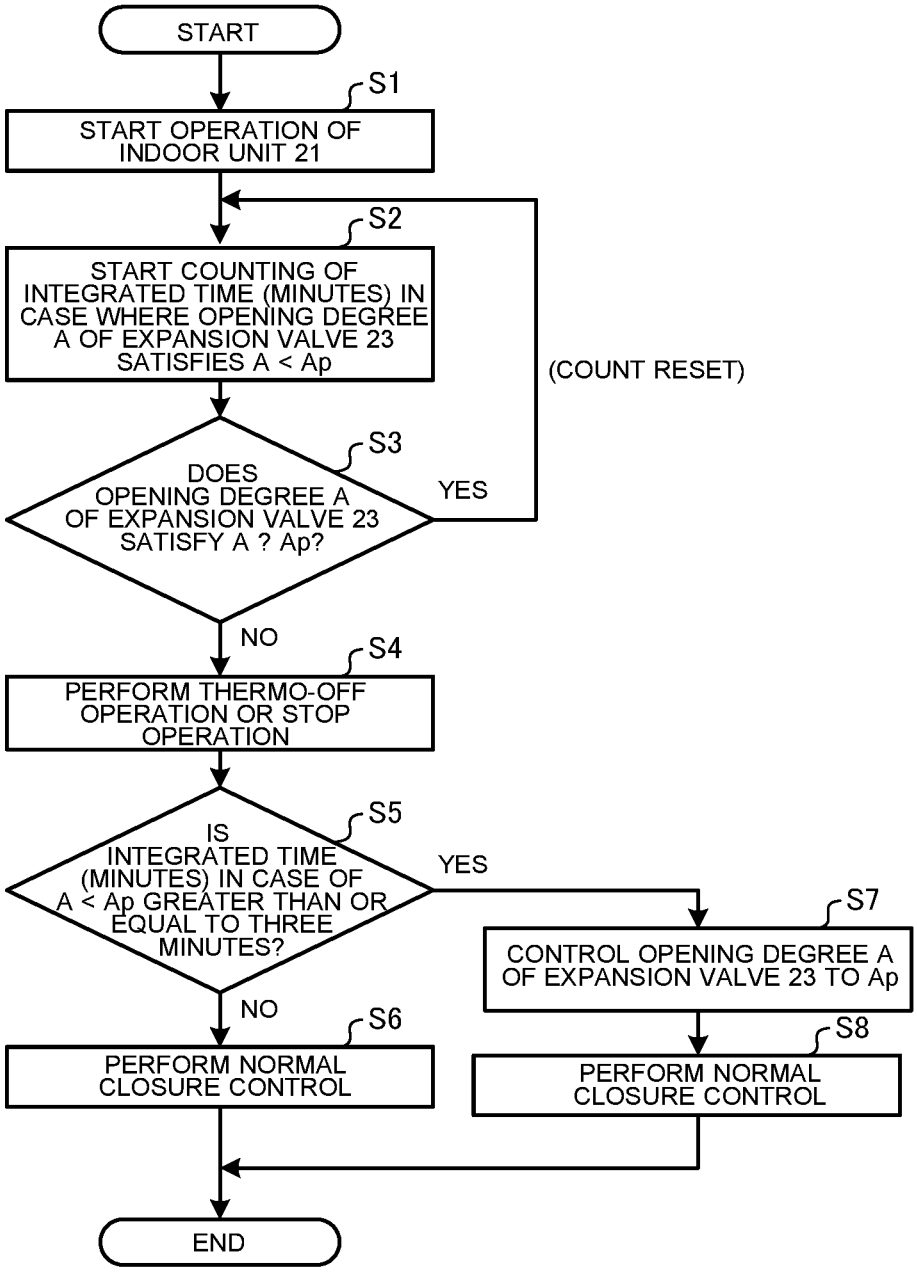
FIG. 3 is a flowchart to explain operation of the air-conditioning apparatus according to the embodiment.

Next, operation of the air-conditioning apparatus 100 according to the embodiment is described. FIG. 3 is a flowchart to explain the operation of the air-conditioning apparatus 100 according to the embodiment.

When operation instruction of the indoor unit 21 is instructed from the remote control 41 of the air-conditioning apparatus 100 (step S1) and the indoor unit 21 is put into a thermo-on state, the controller Cnt opens the expansion valve 23 from a closed state. As a result, the refrigerant is supplied to the indoor heat exchanger 24.

The controller Cnt starts counting of the integrated time (minutes) in the case where the opening degree A of the expansion valve 23 satisfies $A < Ap$ (step S2). The controller Cnt determines whether the opening degree A of the expansion valve 23 satisfies $A \geq Ap$ (step S3).

In a case where the controller Cnt determines in step S3 that the opening degree A of the expansion valve 23 satisfies $A \geq Ap$ (YES in step S3), the controller Cnt resets the count, and the processing returns to step S2. In this case, even in a case where the impurities having passed through the strainer 22_1 or the strainer 22_2 are present in the expansion valve 23, the impurities are released to the downstream side.

In contrast, in a case where the controller Cnt determines in step S3 that the opening degree A of the expansion valve 23 does not satisfy $A \geq Ap$ (NO in step S3), the controller Cnt determines to perform thermo-off operation or stop operation of the air-conditioning apparatus 100 (step S4).

Further, at a timing before operation to close the expansion valve 23 is performed in response to the thermo-off operation or the stop operation, the controller Cnt determines whether the integrated time counted in step S2 is greater than or equal to three minutes (step S5).

In a case where the controller Cnt determines in step S5 that the integrate time (minutes) in the case where the opening degree A of the expansion valve 23 satisfies A<Ap is greater than or equal to three minutes (YES in step S5), the controller Cnt controls the opening degree A of the expansion valve 23 to the set opening degree Ap (step S7). As a result, the expansion valve 23 is opened to be greater than the mesh diameter of each of the strainer 22_1 and the strainer 22_2. Therefore, the impurities stagnating in the gap of the expansion valve 23 are released to the downstream side. Thereafter, the controller Cnt performs normal closure control to close the expansion valve 23 (step S8), and the processing then ends.

In contrast, in a case where the controller Cnt determines in step S5 that the integrated time (minutes) in the case where the opening degree A of the expansion valve 23 satisfies A<Ap is not greater than or equal to three minutes (NO in step S5), the controller Cnt performs normal closure control to close the expansion valve 23 (step S6), and the processing then ends.

Accordingly, the air-conditioning apparatus 100 of the embodiment controls the opening degree A of the expansion valve 23 to the set opening degree Ap at the timing before the operation to close the expansion valve 23 is performed in response to the thermo-off operation or the stop operation of the air-conditioning apparatus 100. As a result, the impurities that have passed through the strainer 22_1 or the strainer 22_2 and collected by the expansion valve 23 during the operation of the air-conditioning apparatus 100 can be released. This reduces a risk that the expansion valve 23 bites the impurities when the expansion valve 23 is closed. In addition, refrigerant leakage caused by damage of the valve shaft and the valve seat of the expansion valve 23 hardly occurs, which improves durability of the expansion valve 23.

Further, the air-conditioning apparatus 100 of the embodiment can prevent the expansion valve 23 from being clogged with the impurities without increasing the mesh diameter of each of the strainer 22_1 and the strainer 22_2. Accordingly, the air-conditioning apparatus 100 of the embodiment can suppress pressure loss in the refrigerant pipe, and enhance efficiency of energy.

Furthermore, in the air-conditioning apparatus 100 of the embodiment, the volume of each of the strainer 22_1 and the strainer 22_2, namely, the surface area of the mesh structure can be reduced. This enables design of the indoor unit 21 of the air-conditioning apparatus 100 at a low cost with a saved space.

Note that the case where the expansion valve 23 of the air-conditioning apparatus 100 is controlled is described in the above-described embodiment; however, the embodiment is applicable to an air-conditioning apparatus controlling a valve other than the expansion valve.

The embodiment is presented for exemplary purposes, and is not intended to limit the scope of the claims. The embodiment can be implemented in other various forms, and various omissions, substitutions, and modifications can be performed without departing from the spirit of the embodiment. The embodiment and modifications thereof are included in the scope and the spirit of the embodiment.

The invention claimed is:

1. An air-conditioning apparatus, comprising:

a refrigerant circuit including a compressor, a strainer, and an expansion valve; and a controller configured to control the expansion valve in the refrigerant circuit, wherein when a set opening degree of the expansion valve is defined as Ap, the controller performs control to measure an amount of time for which the opening degree A of the expansion valve is less than the set opening degree Ap, after operation of the air-conditioning apparatus starts, and responsive to determining that the measured time is greater than a threshold, the controller performs control to cause an opening port diameter of the expansion valve to be greater than a mesh diameter of the strainer and subsequently to close the expansion valve.

2. The air-conditioning apparatus of claim 1, wherein, in a case where the mesh diameter of the strainer is P [mm], the set opening degree Ap of the expansion valve is f(p)×1.1 to 1.4, where f(p) is an expansion valve opening degree at which the opening port diameter of the expansion valve becomes P, and when the controller performs the control to cause the opening port diameter of the expansion valve to be greater than the mesh diameter of the strainer, the controller controls the opening port diameter of the expansion valve to the set opening degree Ap.

3. The air-conditioning apparatus of claim 1, wherein the strainer is one of two strainers in the refrigerant circuit, and the expansion valve is located between the two strainers.

* * * * *